US005796342A

United States Patent [19]

Panov

[11] Patent Number: 5,796,342

[45] Date of Patent: Aug. 18, 1998

[54] DIAGNOSING FLAME CHARACTERISTICS IN THE TIME DOMAIN

[76] Inventor: Yuri S. Panov, 1964D Village Green South, Riverside, R.I. 02915

[21] Appl. No.: 644,820

[22] Filed: May 10, 1996

[51] Int. Cl.[6] ..... G08B 17/12

[52] U.S. Cl. ..... 340/577; 431/13

[58] Field of Search ..... 340/577–579; 250/554; 73/112; 431/13, 75, 78–80; 364/431.051

[56] References Cited

U.S. PATENT DOCUMENTS 4,639,717 1/1987 DeMeirsman ..... 340/578

*Primary Examiner*—Thomas J. Mullen, Jr.
*Attorney, Agent, or Firm*—Barlow & Josephs, Ltd.

[57] ABSTRACT

A method and system for determining flame characteristics in the time domain by analyzing the fluctuations of a time-domain output signal of a flame scanner monitoring a burner flame. A mean level (as well as maximum high and low levels) of the time-domain signal are determined during a predetermined time interval. Numerous intermediate levels are positioned between the mean level and the high and low levels. Several crossing numbers are obtained by counting how often the signal crosses the mean level and the intermediate levels during the time interval. These crossing numbers are plotted on a graph, wherein the crossing numbers are plotted against the relative distance between the levels. A curve is interpolated between the points thus obtained and an area under the curve is determined. The crossing numbers are normalized to the area to obtain normalized crossing numbers. Changes in these normalized crossing numbers are correlated with changes in specific flame characteristics of a particular burner operating under known conditions. Based on this correlation, observed changes in the normalized crossing numbers may then be used to recognize deviations from ideal combustion conditions. Parameters that can be monitored by this method and system include, but are not limited to, fuel-to-air ratio, combustibles and combustion efficiency.

8 Claims, 3 Drawing Sheets

DIAGNOSING FLAME CHARACTERISTICS IN THE TIME DOMAIN

BACKGROUND OF THE INVENTION

1. Field of the Invention

The present invention relates generally to flame diagnosing techniques, and more specifically, to a novel flame diagnosing technique employing fluctuation analysis in the time domain, for use in burner flame management.

2. Background Art

In numerous industrial environments, a hydrocarbon fuel is burned in a boiler or furnace to produce heat. Such industrial furnaces typically employ an array of many individual burners to combust the fuel. To achieve the goal of stable and efficient operation of any combustion apparatus, individual burners should be adjusted so that they are operating at their optimum level. Such adjustments include, but are not limited to, setting the optimum fuel-air ratio and maintaining the optimum distribution of air flows.

Emissions of nitrous oxides or other byproducts are generally monitored to ensure compliance with environmental regulations. When a particular combustion byproduct is found to be produced at unacceptably high concentrations, the offending burner(s) must be serviced or replaced to restore proper operation of the furnace. But, because the measurement of aggregate emissions provides no information as to which burner is responsible for the problem, determining the location (i.e., identity) of the malfunctioning burner can be quite tedious, time consuming, and costly.

Most industrial and utility boilers are equipped with flame monitoring devices (flame scanners) for individual burners. These flame scanners are capable of discriminating between the individual burner flames and the furnace's background fireball, and thereby are able to detect the presence or absence of a flame on each individual burner. The primary output signal generated by a flame scanner has two components: intensity and fluctuating frequency. One of them or a combination of both is used for flame detection. Historically, however, these flame scanners do not provide a means to monitor the combustion quality of an individual burner flame, that is, aside from the absence of such a flame. Others have disclosed methods for analyzing flame combustion quality using frequency domain analysis. While the frequency domain method is useful, it requires a flame scanner output signal to be processed in the frequency domain, which can be complicated.

The advantages and novel features of the present invention will be set forth in part in the description which follows, and in part will become apparent to those skilled in the art upon examination of the following or may be learned by practice of the invention. The advantages of the invention may be realized and attained by means of the methods and instrumentalities particularly pointed out in the appended claims.

SUMMARY OF THE INVENTION

According to the present invention, there is presented a method and system for diagnosing the characteristics of a flame by using fluctuation analysis of a flame scanner signal in the time domain.

According to one aspect of the present invention, a signal from a flame scanner is monitored with a flame sensor to produce a signal. A determination is made of a mean level of the signal and how often the signal amplitude crosses the mean level during a predetermined time interval. According to another aspect, a value is ascertained for at least one flame parameter based at least in part on how often the signal amplitude crosses the mean level in a predetermined interval.

According to a further aspect of the invention, an extreme amplitude of the signal is determined for a first polarity relative to the mean level. At least one intermediate level between the extreme amplitude and the mean level is designated, and it is determined how often the signal crosses the intermediate level during a predetermined time interval. According to yet a further aspect, a value is ascertained of at least one flame parameter based at least in part on how often the signal crosses the intermediate level.

According to another aspect, a function is generated by interpolation between various points. These points represent how often the signal crossed the mean level and each intermediate level during a predetermined time interval. A curve is generated by plotting such points against the spacing between adjacent intermediate levels and between the mean level and intermediate levels adjacent to the mean level. The total area under this curve is calculated and a value of a flame parameter is normalized to this total area.

According to yet another aspect, extreme amplitudes of the signal relative to the mean level are determined for both positive and negative excursions relative to the mean level. A difference is calculated between the extreme amplitudes which, according to another aspect, is used as a basis to ascertain a value of a flame parameter.

According to a further aspect, a flame monitoring system is disclosed. The system has a flame sensor for monitoring a flame and producing a signal representative of radiation from the flame. The system also includes a data processing unit programmed to derive a mean level of the signal during a predetermined time interval and to count how often the signal crosses the mean level.

The objects and advantages of the present invention will become readily apparent to those skilled in this art from the following detailed description, wherein I have shown and described one embodiment of the invention, by way of example only. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

For a more complete understanding of the objects of the present invention, the Detailed Description of the Invention is to be taken in connection with the following drawings, in which.

DETAILED DESCRIPTION OF THE INVENTION

The time domain signal output by a flame scanner may be considered to have or be defined by two characteristics:

intensity and frequency. The frequency component of such a signal has been discovered to be highly sensitive to changes in flame conditions. In fact, there appears to be a direct correlation between the frequency of the signal output of a flame scanner and the quality of the scanned flame. The correlation of flame fluctuation with flame quality and emissions can be understood as follows.

The most critical parameter controlling burner flame quality is the ratio of fuel to air (i.e., the fuel-to-air ratio). As air is turbulently mixed with fuel and combusted in each burner, a multitude of various size recirculation loops and eddies are formed inside and around the flame thus created. Furthermore, the flame itself is comprised of turbulent eddies or flamelets which travel inside of the recirculation loops. The movement of eddies in turbulent flows affects the mixing rate of air and fuel in turbulent diffusion flames.

Every time a turbulent eddy occurs, it mixes fuel (for example, coal or pyrolysis products) with air. Hence, the amount of fuel and air that is mixed is controlled in part by the size of the eddy. Because the chemical kinetics are extremely fast compared to the air/fuel mixing rate, the intensity of the radiation resulting from the combustion process is dominated by the mixing rate. Since large eddies may entrain more fuel than smaller eddies, large eddies should give a larger emission intensity. Knowing this, the pattern of distribution of fluctuational energy in the time domain, which is a function of flame turbulence and fuel/air mixing rate, can be used to measure specific flame parameters.

Extensive experimental testing of burners and flame scanners and the corresponding data analysis have demonstrated that the pattern of distribution in the time domain can be correlated with flame combustion parameters, and can be utilized to monitor and optimize the operating conditions of individual burners.

Figure 1:
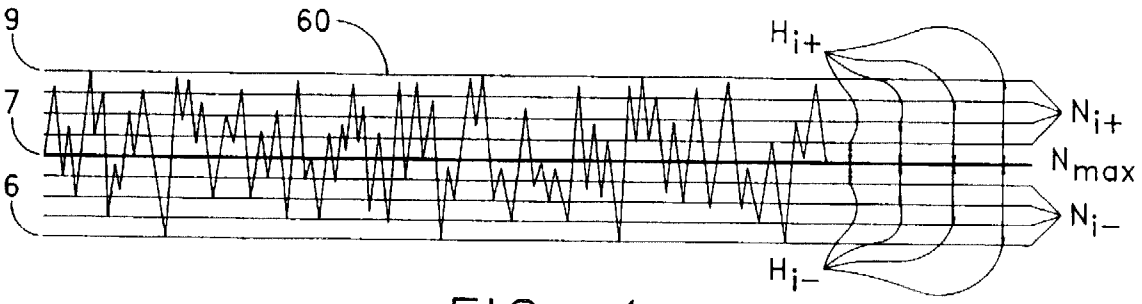
FIG. 1 illustrates a typical flame signal in the time domain.

Referring to FIG. 1, an illustration of a typical signal 60 from a flame sensor is shown. This signal 60 is depicted in the time domain with time extending along the horizontal axis and amplitude fluctuating vertically. The duration of the signal 60 shown represents a typical testing interval, during which a number of parameters of the signal 60 can be checked. The same checking preferably is done in each succeeding interval. The mean level 7 represents the average value of the amplitude of the signal 60 during the testing interval. The extreme amplitude 9 in a positive polarity relative to the mean level 7 is obtained by taking, for example, an average value of the ten (or some other number of the) most-positive peaks during the testing interval. This is done to avoid basing any measurements on signal anomalies (e.g., noise spikes). Likewise, the extreme amplitude 6 in a negative polarity relative to the mean level 7 can be obtained by taking an average value of several of the most-negative peaks during the testing interval. Intermediate levels $H_{i+}$ are positioned between extreme amplitude 9 and the mean level 7, and intermediate levels $H_{i-}$ are positioned between extreme amplitude 6 and the mean level 7 ("i" being an integer representing each of the individual levels). Preferably, these levels are positioned equal distances from each other.

Typically, the signal 60 crosses the mean level 7 more often than any other level. Thus, the number $N_{Max}$ represents the number of crossings of the signal 60 with the mean level 7 during the testing interval. The number of crossings with intermediate levels $H_{i+}$ and $H_{i-}$ are represented by numbers $N_{i+}$ and $N_{1-}$, respectively.

Figure 2B:
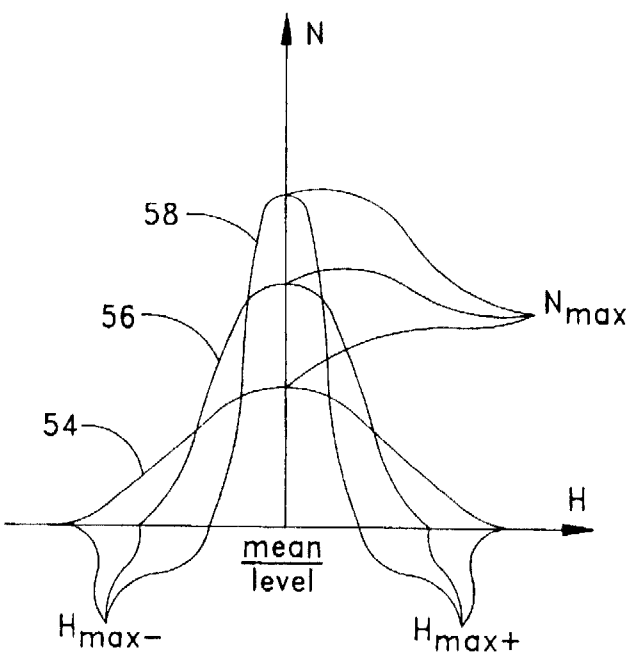
FIG. 2*b* illustrates variations of the distribution function $N_i=f(H_i)$ which may be brought about by changes of burner operating conditions.
Figure 2A:
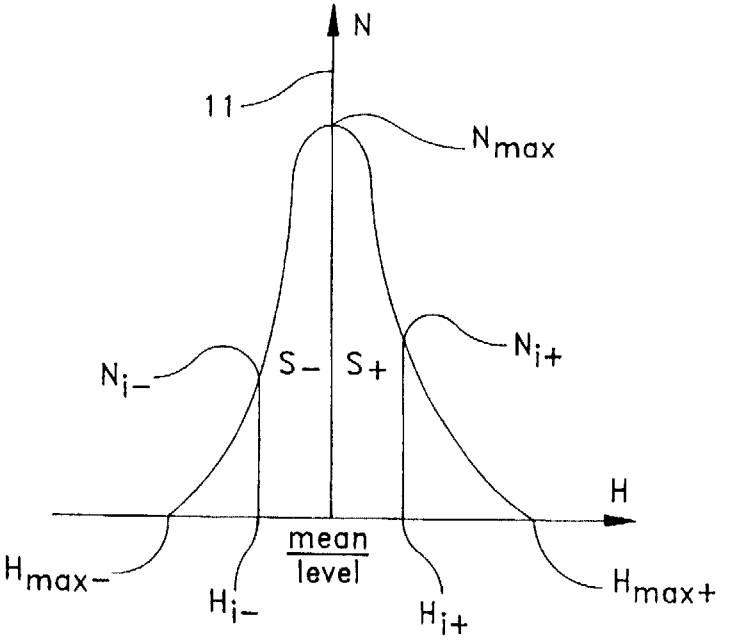
FIG. 2*a* presents a graphical illustration of an exemplary distribution function $N_i=f(H_i)$ according to the invention.

Referring next to FIG. 2*a*, a graph is shown which represents a typical distribution of the function $N_1=f(H_i)$. This function represents the number of times ($N_i$) the signal 60 crossed with each of the levels ($H_{i-}$, the mean level 7, $H_{i+}$) during a particular testing interval. Again, $H_{i-}$ and $H_{i+}$ could each represent several discrete levels. As can be observed from this diagram, the number of crossings with a particular level $H_{i-}$ (represented by $N_{i-}$) need not correspond with the number of crossings with level $H_{i+}$ (represented by $N_{i+}$) for the same value of the integer i. Thus, the curve will not necessarily be symmetrical about the N axis 11.

Still referring to FIG. 2*a*, S− represents the area under the curve to the left of the N axis 11, and S+ represents the area under the curve to the right of the N axis 11. S− and S+ are calculated as follows. First, a curve is interpolated between adjacent level crossing numbers (i.e., $N_i$, for all adjacent values of i) that correspond to each adjacent level (i.e., $H_i$, for all adjacent values of i). For this interpolation, $H_{Max-}$ and $H_{Max+}$ are taken to have a crossing value of "0." The interpolated curve may be a simple linear (point-to-point) interpolation, or, with appropriate assumptions about specific characteristics of the curve (e.g., the slope of the curve at $H_{Max-}$ and $H_{Max+}$), it may be a higher-order interpolation (e.g., a cubic spline interpolation). Next, the area under each of the portions of the curve between the adjacent levels is calculated. Finally, S− is calculated by summing the areas under the portions of the curve to the left of the N axis 11, and S+ is calculated by summing the areas under the portions of the curve to the right of the N axis 11. The total area under the curve, $S_{Tot}$, may also be calculated by summing S− and S+.

Next referring to FIG. 2*b*, various distributions of the function $N_i=f(H_i)$ are depicted. As can be seen, the value of $N_{Max}$ for curve 58 is greater than the value of $N_{Max}$ for curve 56, which is greater than the value of $N_{Max}$ for curve 54. Such changes in the distribution function $N_i=f(H_i)$ are believed to follow changes in the operating conditions of the burner being tested.

The total area under the distribution curve, $S_{Tot}$, can be used as a normalizing value to normalize parameters such as $N_{Max}$. A normalized value of $N_{Max}$ may be obtained simply by dividing $N_{Max}$ by $S_{Tot}$ ($N_{MaxNorm}=N_{Max}/S_{Tot}$). The normalized value of $N_{Max}$ is particularly significant in determining the optimum fuel-to-air ratio of a burner.

Figure 3:
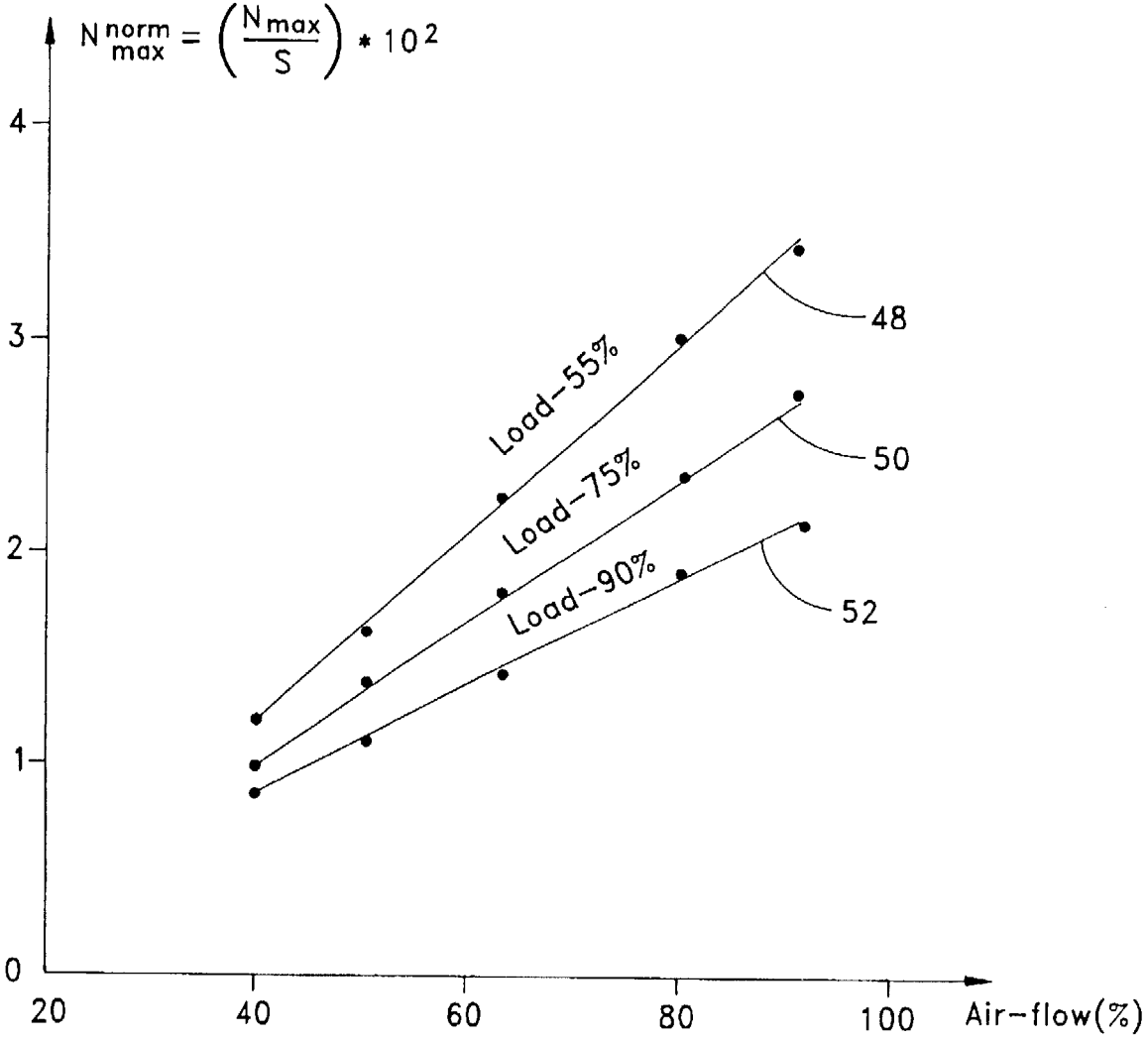
FIG. 3 is a graph of the correlation of fuel-to-air mixture with the number of the crossings of a flame signal with a mean level of the signal.

Referring now to FIG. 3, this graph shows how an increase in the value of $N_{MaxNorm}$ corresponds almost linearly with an increase in the fuel-to-air ratio of a burner. Curves 48, 50, and 52 represent burner loads of 55%, 75% and 90%, respectively. Thus, based on observed changes to the value of $N_{MaxNorm}$, an operator could optimize the fuel-to-air ratio of an individual burner within an array.

Figure 4:
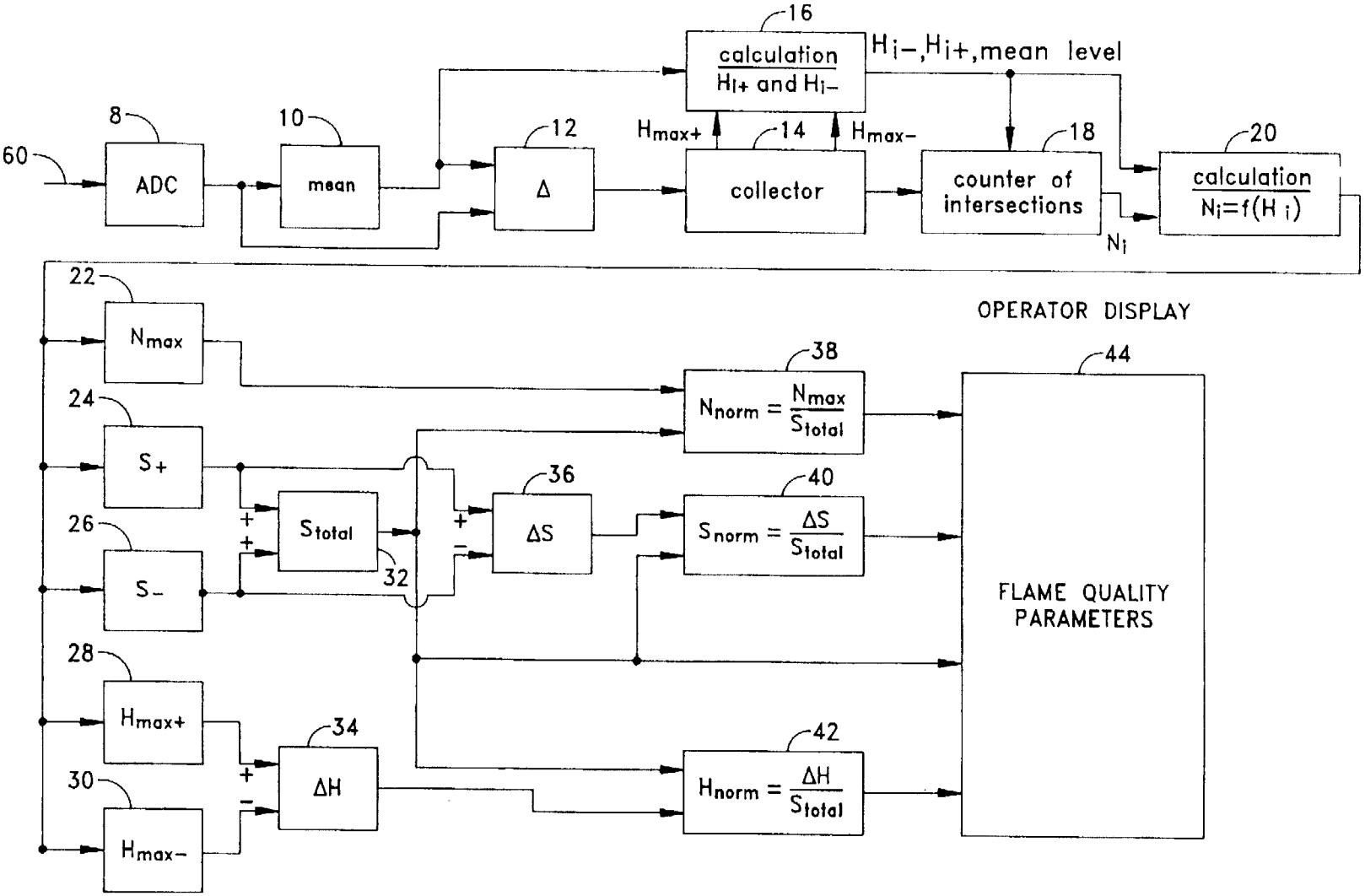
FIG. 4 is a block diagram of an exemplary implementation of the present invention.

Referring next to FIG. 4, an example is depicted of a system architecture of the present invention. Several of the blocks (hereinafter "units") represent circuitry or sections of a programmed computer that are wired or programmed to perform the described steps. In the preferred embodiment a single processor executing supporting software is used to implement all of the units (not including the analog-to-digital converter 8 and the operator display 44), but the invention need not be so limited.

An input signal 60 from a flame scanner is first converted from analog-to-digital format by analog-to-digital converter (ADC) 8. ADC 8 may be, for example, a data acquisition card for a digital computer. As is well known in the art, the signal 60 must be sampled at a rate of at least twice the maximum frequency that is desired to be recovered. Therefore, 1000 samples per second should be sufficient to recover frequencies or frequency components up to 500 Hertz.

Unit 10 determines the mean level 7 of the sampled signal 60. The mean level 7 is provided to a subtractor unit 12. The subtractor unit 12 measures the difference between the mean level 7 of the sampled signal 60 and the sampled signal 60 itself. This difference is fed to a collector unit 14, which collects data from the subtractor unit 12 throughout the entire duration of a testing interval, typically about 5 seconds. Essentially, this collected data represents the magnitude of all deviations of the sampled signal 60 from the mean level 7 during the testing interval.

An alternative approach could also be used instead of ascertaining the magnitude of the deviations of the signal 60 from the mean level 7 and storing the deviation values in the collector 14. That is, the sampled flame signal 60 could be collected directly for the duration of a testing interval and a single mean level 7 could be determined for the entire testing interval based upon the collected data. Such an alternative method would correspond to a flame signal 60 sampled during a testing interval and the resulting mean level 7, such as that shown in FIG. 1.

Referring still to FIG. 4, the collector unit 14 also determines average maximum and minimum deviations ($H_{Max+}$ and $H_{Max-}$) of the sampled signal 60 from the mean level 7. This is done, for example, by averaging the ten most-positive deviation values and by averaging the ten most-negative deviation values collected during the sampling interval.

Unit 16 determines locations of levels $H_{i+}$ and $H_{i-}$ for several values of i. The determination of locations of levels $H_{i+}$ is accomplished by positioning intermediate levels between $H_{Max+}$ and the mean level 7. Locations of (i.e., values for) levels $H_{i-}$ are determined by positioning intermediate levels between $H_{Max-}$ and the mean level 7. The locations of levels $H_{i+}$, $H_{i-}$ and the mean level 7 are then fed to unit 18, where data collected in unit 14 is processed to determine how many times the deviation values collected in unit 14 crossed with the mean level 7 and each of levels $H_{i+}$ and $H_{1-}$ during the testing interval. These crossing values ($N_{Max}$, $N_{i+}$ and $N_{i-}$) are provided to unit 20, where they are correlated with the mean level 7 and the locations of levels $H_{i+}$ and $H_{i-}$ in the form of a distribution function $N_i=f(H_i)$, such as the distribution functions shown in FIGS. 2*a* and 2*b*. As described in conjunction with FIG. 2*a*, the function $N_i=f(H_i)$ is a curve that has been interpolated between (adjacent) level crossing numbers (i.e., $N_i$, for all values of i) corresponding to adjacent levels (i.e., $H_{Max-}$, $H_{i-}$, the mean level 7, $H_{i+}$ and $H_{Max+}$, for all values of i).

Still referring to FIG. 4, several parameters are calculated based upon the distribution function determined by unit 20. Initially, a value of S+ is calculated by unit 24 by calculating the total area under the curve to the right of the N axis 11. Similarly, a value of S− is calculated by unit 26 by calculating the total area under the curve to the left of the N axis 11. A total area $S_{Tot}$ is then calculated by unit 32 by summing S+ and S−. This value of $S_{Tot}$ is used by the system as a normalizing value by which to normalize other parameters.

Unit 36 calculates the difference between S+ (from unit 24) and S− (from unit 26) to obtain a difference value (ΔS). Unit 40 then takes the value of ΔS calculated by unit 36 and divides it by $S_{Tot}$ to obtain a normalized value of ΔS ($\Delta S_{Norm}$).

Unit 22 takes the value $N_{Max}$ and feeds it to unit 38, where it is divided by $S_{Tot}$ to obtain a normalized value of $N_{Max}$ ($N_{MaxNorm}$).

Unit 34 calculates the difference between the value of $H_{Max+}$ from unit 28 and the value of $H_{Max-}$ from unit 30 to obtain a value ΔH. Unit 42 divides ΔH by $S_{Tot}$ to obtain a normalized value of ΔH ($\Delta H_{Norm}$).

The values of $S_{Tot}$ from unit 32, $N_{MaxNorm}$ from unit 38, $\Delta S_{Norm}$ from unit 40, and $\Delta H_{Norm}$ from unit 42 are provided to an operator display 44 where they are displayed to an operator. Operator display 44 preferably displays an array of bar-graphs and/or strip charts showing the present value of parameters indicative of, for example, air flow (i.e., fuel-to-air ratio), burner load, and/or combustibles (i.e., burner efficiency).

Various correlations may be determined experimentally between the parameter values ascertained by the instant invention and the quality of a flame emitting from a particular burner type. That is, for a particular burner, the user can determine experimentally how changes in operating conditions and flame quality correspond with measured values of $N_{i+}$, $N_{i-}$, $N_{Max}$, ΔS, ΔH (both normalized and un-normalized). From this data, the user is able to identify (for the particular type of burner) any deviations from the burner's ideal operating conditions by merely observing changes in the measured parameters and drawing appropriate conclusions based on the experimental data previously obtained.

Given the large number of parameters that can be measured, it is apparent that, a user might benefit from the use of an expert system (i.e., a programmed digital computer) to facilitate the post-measurement data analysis. This may be the same data processing system that performs the parameter measurements and calculations, or it may be a separate expert system. In either case, with a properly programed expert system, a detailed comparison between the measured parameters and the predetermined experimental data may be easily performed. The expert system may then, based upon preselected criteria, notify the user of an anomaly in the burner flame's quality (i.e., trigger an alarm).

While the particular illustrative embodiment shown and described above will be useful in many applications, further modifications to the present invention herein disclosed will occur to persons skilled in the art. All such modifications are intended to be within the scope and spirit of the present invention, which is defined and limited only by the appended claims and equivalents thereof.

What is claimed is:

1. A method for determining characteristics of a flame comprising the steps of:

providing a time-domain signal indicative of instantaneous flame condition;

determining a mean level of said time-domain signal during a selected time interval;

counting how often said time-domain signal crosses said mean level during said time interval;

determining an extreme amplitude of said time-domain signal during said time interval, said extreme amplitude being determined relative to said mean level for both polarities relative to said mean level;

designating at least one intermediate level between said extreme amplitude and said mean level; said designating at least one intermediate level between said extreme amplitude and said mean level includes designating at least one intermediate level between each of said extreme amplitudes and said mean level; and counting how often said time-domain signal crosses said intermediate level during said time interval.

2. The method for determining characteristics of a flame as claimed in claim 1 further comprising the step of ascertaining a value of at least one flame parameter based at least in part on how often said time-domain signal crosses said mean level during said time interval.

3. The method for determining characteristics of a flame as claimed in claim 2 further comprising the step of displaying said value of said flame parameter.

4. The method for determining characteristics of a flame as claimed in claim 1 further comprising the step of ascertaining a value of at least one flame parameter based at least in part on how often said time-domain signal crosses said intermediate level during said time period.

5. The method for determining characteristics of a flame as claimed in claim 1 further comprising the steps of:

interpolating a curve between a plurality of points representing how often said time-domain signal crossed said mean level and said intermediate levels during said time interval, said points being plotted against a relative spacing between adjacent intermediate levels and between said mean level and intermediate levels adjacent to said mean level; and calculating a total area under said curve.

6. The method for determining characteristics of a flame as claimed in claim 5 further comprising the steps of:

ascertaining a value of at least one flame parameter based at least in part on how often said time-domain signal crosses said mean level during said interval; and normalizing said value of said flame parameter to said total area under said curve to obtain a normalized value.

7. The method for determining characteristics of a flame as claimed in claim 6 further comprising the step of displaying said normalized value.

8. The method for determining characteristics of a flame as claimed in claim 1 further comprising the step of converting said time-domain signal from analog to digital format prior to determining a mean level of said time-domain signal.

* * * * *